US005341927A

United States Patent [19]

Coyner

[11] Patent Number: 5,341,927

[45] Date of Patent: Aug. 30, 1994

[54] GOLF GRIP HEATER FOR GOLF BAG

[76] Inventor: Vincent E. Coyner, 1402 Pine Grove Rd., Capitol Heights, Md. 20743

[21] Appl. No.: 13,954

[22] Filed: Feb. 5, 1993

[51] Int. Cl.[5] ..... A63B 55/00; H05B 3/06

[52] U.S. Cl. ..... 206/315.3; 206/315.5; 206/315.6; 219/521; 219/528

[58] Field of Search ..... 206/315.2, 315.3, 315.5, 206/315.6, 315.9; 219/521, 528

[56] References Cited

U.S. PATENT DOCUMENTS

| | | | |
|---|---|---|---|
| 3,079,486 | 2/1963 | Winchell | 219/528 |
| 3,497,676 | 2/1970 | Gravatt | 206/315.9 X |
| 3,707,279 | 12/1972 | Kaiser | 206/315.6 X |
| 4,155,002 | 5/1979 | Cohen | 206/315.9 X |
| 4,279,255 | 7/1981 | Hoffman | 219/528 X |
| 4,420,681 | 12/1983 | Arnold | 206/315.9 X |
| 4,545,362 | 10/1985 | Hendricks | 206/315.9 X |
| 4,664,382 | 5/1987 | Palmer et al. | 206/315.6 X |
| 4,762,978 | 8/1988 | Tanis | 219/528 X |
| 4,810,859 | 3/1989 | Anabtawi et al. | 219/528 X |
| 4,994,396 | 7/1990 | Larkin | 206/315.6 |
| 5,062,528 | 11/1991 | Whitaker, Jr. | 206/315.3 |

FOREIGN PATENT DOCUMENTS

| | | | |
|---|---|---|---|
| 2234912 | 2/1991 | United Kingdom | 206/315.3 |

*Primary Examiner*—Sue A. Weaver

[57] ABSTRACT

A golf bag having a battery powered heating element for heating the grips of golf clubs comprises a flexible heating pad which is adapted to be formed into a cylindrical shape for insertion into a golf bag so as to surround the grips of golf clubs inserted into the bag.

13 Claims, 2 Drawing Sheets

GOLF GRIP HEATER FOR GOLF BAG

FIELD OF THE INVENTION

The field of invention relates to a product that is designed to be placed inside of a golf bag in order to heat the grips of the golf clubs during times of cold weather when they become cold, hard and uncomfortable to grip.

SUMMARY OF THE INVENTION

Golf grips have two primary functions. One is to provide the golfer with some sort of surface that is conducive to maintaining a stable grasp on the club which they could not attain if they were forced to grasp the slick metal shaft itself. The second function of a golf grip is to act as a shock absorber, protecting the golfer from the "sting" that would otherwise be associated with hitting a hard ball with a hard metal stick. It is this second function that this invention is concerned with. During times of pleasant, warm weather, the grips (which are typically constructed out of rubber or leather) are relatively soft and flexible which allows them to absorb that "sting". During times of cold weather, grips become hard and inflexible, which essentially eliminates their ability to act as shock absorbers. The present invention is intended to directly address that problem and return shock absorbing qualities to the grips. This is to be done by heating the grips of the clubs while they sit in the golf bag.

The heating element of Therma Grip is to be powered by electricity. There are two possible sources for that electricity, either of which will couple with a plug that sits outside the top of the golf bag, which is attached to the heating element via an electrical cord running inside the golf bag. The primary source of power would be a cable that is attached to the batteries that run golf carts. The second possible source would be a battery pack that is mounted on the side of the golf bag for players who do not ride in golf bags.

The preceding was a discussion of the general concept and the motivation for the product. This is provided to provide all interested parties including but not limited to: the U.S. Patent and Trademark Office, scientists, engineers, & the golfing public in general a picture of what this invention deals with, and to provide them with an understanding of the concepts protected by this patent. It is intended that these claims include any and all configurations that may be designed that utilize the basic tenants of this invention and remain within its spirit and scope.

OBJECTS OF THIS INVENTION

It is an object of this invention to provide a heating element into pre-existing golf bags that will heat the grips of golf clubs as they sit in the golf bag. The invention is intended to be a freestanding object, manufactured separately from golf bags. This freestanding product will be configured in such a manner that it will be capable of being introduced into a wide variety of golf bag configurations. This statement is not intended to preclude the possibility of this product being offered to golf bag manufacturers for incorporation into their golf bag designs.

It is another object of this invention to have the invention powered in two manners:

Either of the following two power sources would couple with a plug that is connected with an electrical cord the runs the length of the golf bag on the inside and is connected with the heating element in the base of the bag.

1. The primary power source configuration entails a cable that is attached to the batteries that power a player's golf cart. This cable will plug into the above mentioned plug that sits outside of the top of the golf bag.
2. A second power source configuration would call for a battery pack that is attached to the side of player's golf bag and plugs into the plug mentioned above which delivers the power to the heating element.

It is an additional object of this invention that the invention will incorporate a Styrofoam disk that will sit inside the golf bag flush with the top of the heating element and will act as a barrier to heat escaping through the top of the golf bag.

It is an additional object to this invention that it is to be manufactured in such a way that it can be brought forth for sale to the general golfing public at a reasonable cost.

DETAILED DESCRIPTION OF THE DESIGN OF THIS INVENTION

Figure 1B:
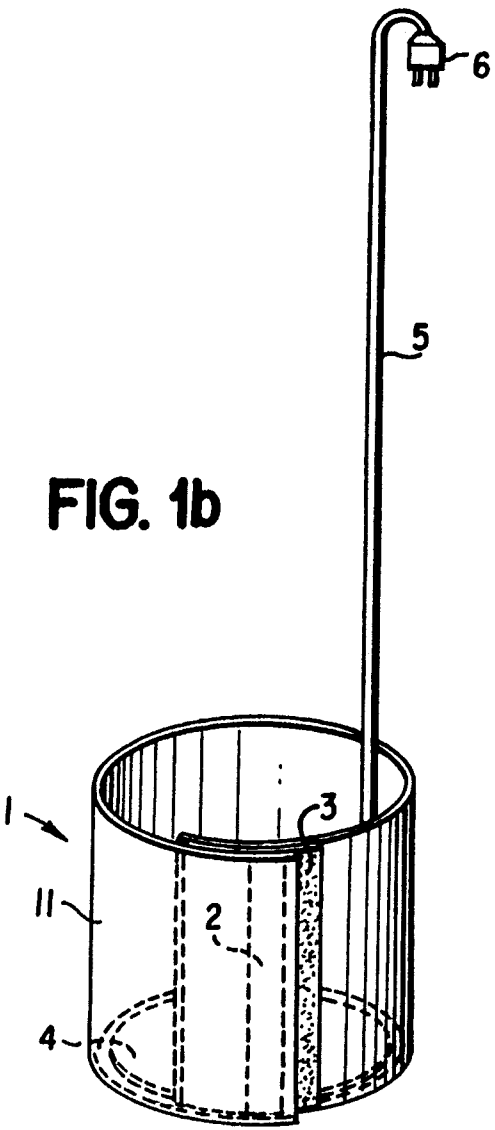
FIG. 1*b*. Shows the same elements in FIG. 1*a*, once the heating element has been configured into a cylinder, ready to be set into a golf bag.
Figure 1A:
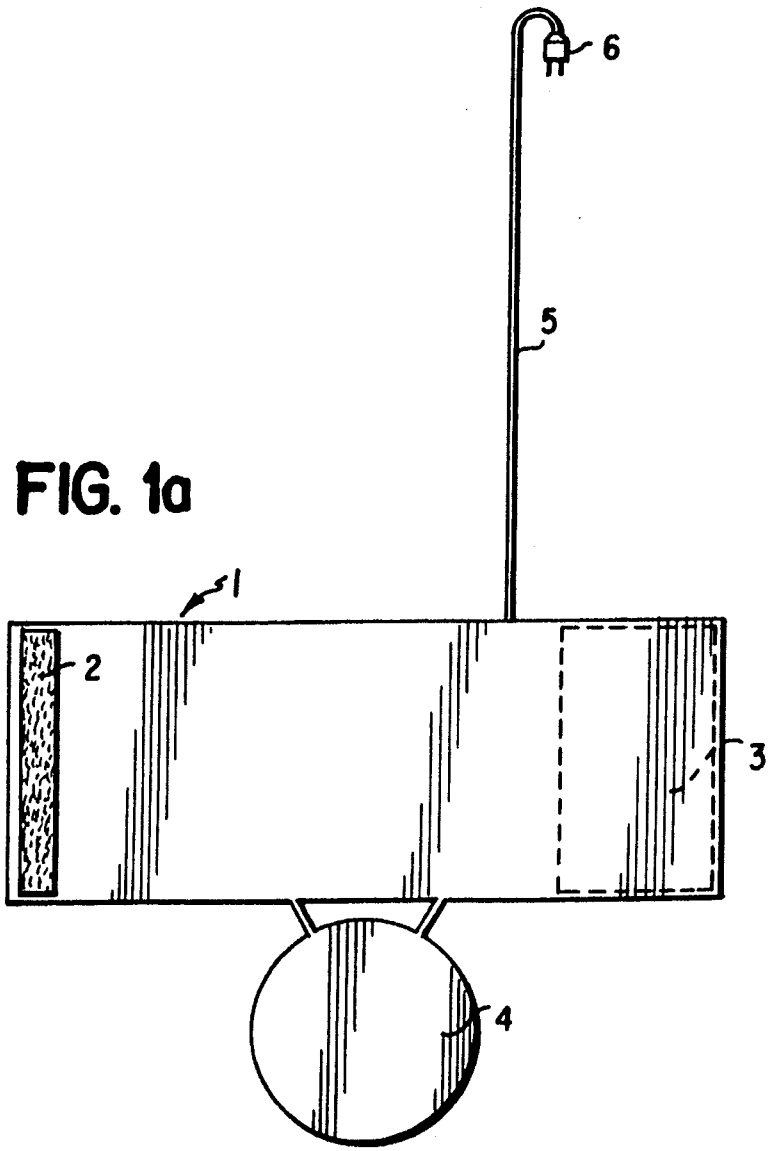
FIG. 1*a*. Shows the heating element of the invention before it is configured into a cylinder.

FIG. 1*a* shows a picture of the flexible heating element 1. This element 1 is to be similar to a strengthened heating pad or a waterbed heater. It will incorporate electrically powered heating elements within a flexible material that can be curled into a cylindrical shape. The ends of the heating element 1 will be secured to one another by a hook and loop-type fastener 23. The element will be of adequate length to enable the product to be wrapped into cylinders of varying diameters to allow Therma Grip to be introduced into the widest number of golf bags possible. The cylindrical portion of the element will stand approximately 12 inches high along the inside bottom of the golf bag's walls. Attached to the cylindrical/rectangular portion of the heating element will be a circular element 4 that will lay flat on the bottom of the golf bag. Both the circular bottom element 4 and the cylindrical portion of the heating element will have insulation on the sides that face outwards, in order to reduce the amount of heat lost through the walls of the bag. An electrical cord 5 is connected to the heating element 1 and is adapted to extend along the inside of a golf bag and to connect to an electrical power source by means of a plug 6.

Figure 2:
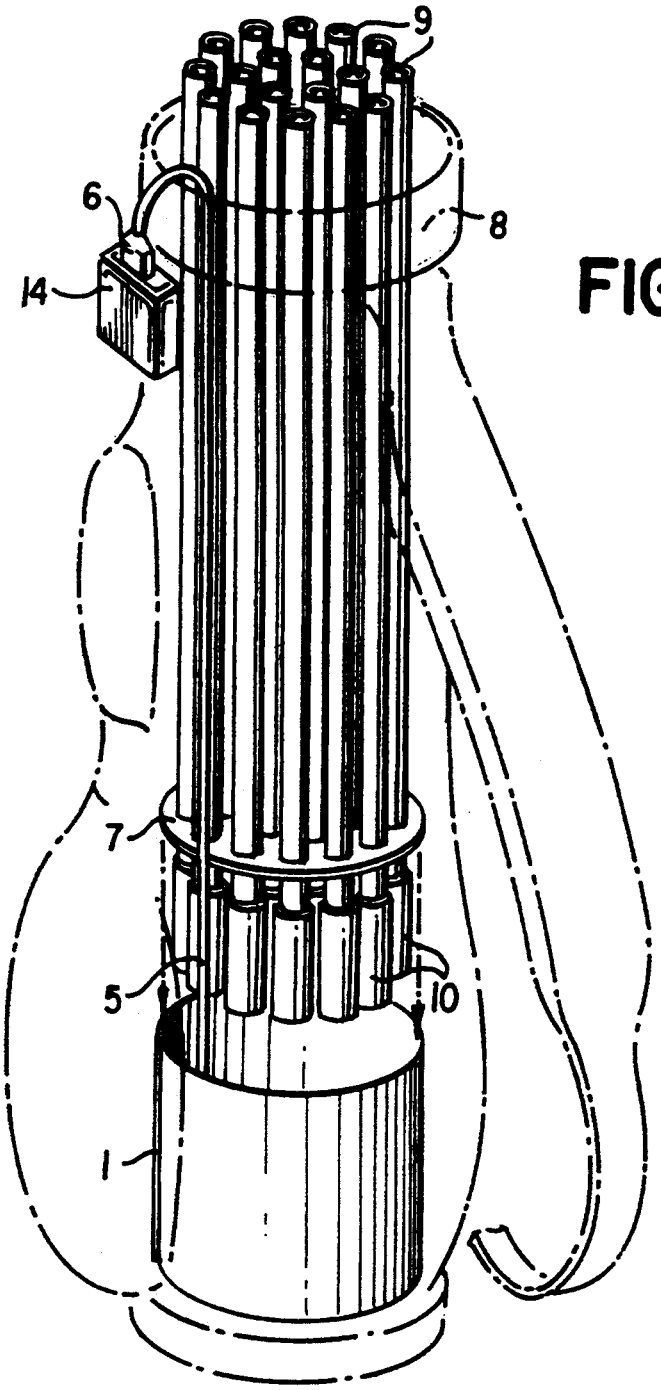
FIG. 2. Shows the configuration of the invention once it is installed in the golf bag.
Figure 3:
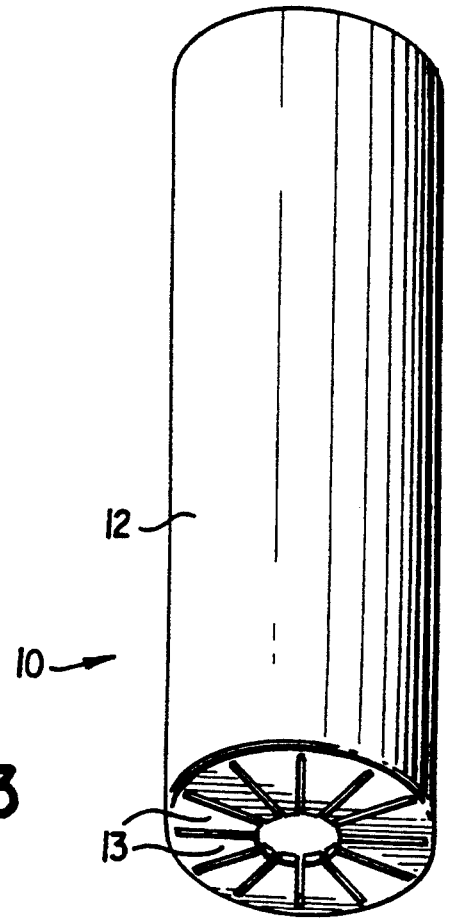
FIG. 3 Shows a possible design for the slip on adaptors with finger-like protrusions to be added to the bottom of the tubes in FIG. 2.

Referring now to FIG. 2, in order to keep the heat from escaping from the top of the bag, the invention will include a round disk 7, formed of a thick styrofoam like substance. The disk 7 shall have 15 perforated holes through which to fit the tubes 9 that typically hold golf clubs. The golfer will poke out as many of the holes as is necessary to accommodate the number of clubs he/- she typically carries in their bag. Players typically use tubes that run the length of their bags to contain the club shaft and allow for smooth and orderly insertion and withdrawal of the golf clubs. With the invention, these tubes will be slid into the disk 7 so that when the tubes are set into the bag, the disk 7 is suspended approximately 12 inches from the bottom of the bag, and sits flush with the top of the cylindrical section of the heating element. The lower ends of the tubes 9 are spaced above the bottom of the bag as shown in FIG. 2 so that the heating element 1 can readily heat the grips of the clubs. The disk 7 will be configured so that it can be accommodated in bags of differing diameters. Special tubes with fingerlike protrusions may be required to minimize the gap at the bottom of the tubes created by the difference between their diameter and the diameter of the golf clubs themselves. This may also be accomplished by providing slip on adaptors with fingerlike protrusion for pre-existing tubes. FIG. 3 illustrates one possible form of an adaptor 10 which comprises a tubular portion 12 with a plurality of finger-like protrusions 13. The tubular portion 10 slips onto the bottom of the tubes 9 and the protrusions 12 minimize the gap at the bottom of the tubes 9 that results from the aforementioned diameter difference. These options are necessary in order to reduce the amount of heat that is allowed to escape through the tubes themselves. Once the tubes and the disk 7 are in place, there should be little escape of heat from the top of the bag.

The invention is to have two possible sources of power for the heating element. Either method will couple with the plug at the top of the bag which is connected with the electrical cord that runs to the heating element at the bottom of the bag. The primary power source configuration entails a cable that is attached to the batteries that power a player's golf cart. This cable will connect with the abovementioned plug that sits outside of the top of the golf bag. A second method of power for the invention calls for a battery pack 14 (FIG. 2) that is attached to the side of a player's golf bag and couples with abovementioned plug.

These statements detailing the configuration of this invention are stated to be preliminary, and that in stating so, I emphasize that modifications may occur in its design. As such, it is intended that the descriptions provided above and below are not to be construed to limit the invention to the exact fabrication and description provided. Any and all modifications that occur in the process of construction of the invention are to be considered within the protection of this patent.

I claim:

1. In combination with a golf bag having an upper opening, a bottom, and a central axis, said golf bag being adapted to receive golf clubs with grips, a heater for heating the grips of the golf clubs, said heater comprising a flexible electrical heating element adapted to be removably inserted in and removed from the golf bag through the upper opening thereof.

2. The combination of claim 1, wherein said flexible heating element comprises a generally rectangular member with first and second pairs of opposing edges, means mounted adjacent the first pair of said opposing edges for removably fastening such edges together with said heating element formed in a cylindrical shape for insertion into said golf bag.

3. The combination of claim 2, wherein said fastening means comprises Velcro strips.

4. The combination of claim 1, wherein said flexible heating element has first and second side surfaces, said first side surface being disposed inwardly facing the central axis of the golf bag and said second side surface being disposed outwardly facing away from the central axis of the golf bag and first insulating means on said second side surface for retaining the heat in said golf bag.

5. The combination of claim 4, including second insulation means connected to an edge of the heating element for retaining the heat in the bottom of the golf bag.

6. The combination of claim 5, wherein said second insulation means comprises a circular insulator adapted to rest on the bottom of the golf bag.

7. The combination of claim 5, including third insulation means disposed in said golf bag above said heating element for retaining the heat in the golf bag.

8. The combination of claim 7, wherein said third insulation means comprises a circular disk with a plurality of holes therein for receiving the grips of the golf clubs.

9. The combination of claim 8, wherein said circular disk is made of an insulating material and including a plurality of tubes extending through the holes in the disk in which the grips of the golf clubs are adapted to be received.

10. The combination of claim 9, wherein said tubes comprise cylindrical tubes having top and bottom ends and a plurality of cylindrical adaptors each fitted to a respective end of a tube, each adaptor having a plurality of radially inwardly directed, flexible protrusions for engaging a golf club passing through the tube associated therewith for providing a barrier to heat passing upwardly through the tube.

11. The combination of claim 9, wherein said tubes each have top and bottom ends and including a plurality of flexible protrusions extending radially inwardly from one end of the tubes to provide a barrier to heat passing upwardly through said tubes.

12. The combination of claim 1, including an electrical power cord operatively connected to said heating element and adapted to extend to the upper opening of the golf bag, said power cord being adapted to be connected to a battery carried by said golf bag.

13. The combination of claim 1, including an electrical power cord operatively connected to said heating element and adapted to extend to the upper opening of the golf bag, said power cord being adapted to be connected to a golf cart battery.

* * * * *